US011470935B2

(12) United States Patent
Newland

(10) Patent No.: US 11,470,935 B2
(45) Date of Patent: Oct. 18, 2022

(54) SYSTEM FOR CARRYING EYEGLASSES AND CELL PHONES

(71) Applicant: Vernice Newland, New York, NY (US)

(72) Inventor: Vernice Newland, New York, NY (US)

( * ) Notice: Subject to any disclaimer, the term of this patent is extended or adjusted under 35 U.S.C. 154(b) by 0 days.

(21) Appl. No.: 16/213,275

(22) Filed: Dec. 7, 2018

(65) Prior Publication Data

US 2022/0279909 A1 Sep. 8, 2022

(51) Int. Cl.
*A45C 11/04* (2006.01)
*A45C 11/00* (2006.01)

(52) U.S. Cl.
CPC ..... *A45C 11/04* (2013.01); *A45C 2011/002* (2013.01); *A45F 2200/0541* (2013.01)

(58) Field of Classification Search
CPC ..... A45C 11/04; A45C 2011/002; A45C 2000/0541
USPC ..... 206/5
See application file for complete search history.

(56) References Cited

U.S. PATENT DOCUMENTS 2,697,838 A * 12/1954 Bove ..... A41B 15/02 2/279
3,381,806 A * 5/1968 McDonagh ..... A45C 11/04 206/5
3,492,677 A * 2/1970 Bertelinkjan ..... A41B 15/00 2/279
4,290,522 A * 9/1981 Takasaki ..... A45C 11/04 206/233
4,667,347 A * 5/1987 Greer ..... A41D 27/20 2/247
4,823,943 A * 4/1989 Chang ..... A45C 11/005 150/143
4,984,682 A * 1/1991 Cummins ..... A45C 11/04 206/5
5,032,019 A * 7/1991 Burchett ..... A45C 11/04 206/5
5,231,702 A * 8/1993 Masters ..... A41B 15/02 2/244
5,590,760 A * 1/1997 Astarb ..... A45C 11/04 206/5
5,772,014 A * 6/1998 Jacober ..... A45C 11/005 150/116
D406,460 S * 3/1999 Newcomer ..... D3/265
5,924,558 A * 7/1999 De Mayo ..... A45C 11/04 206/37
6,003,663 A * 12/1999 Newcomer ..... A45C 11/04 206/315.1
D425,303 S * 5/2000 Klonowski ..... D3/201
6,116,412 A * 9/2000 Rogers ..... A45C 11/04 206/5
6,581,760 B1 * 6/2003 Robertson ..... A45C 11/04 206/320

(Continued)

*Primary Examiner* — Ernesto A Grano

(57) ABSTRACT

A system for holding a pair of eyeglasses, the system comprises: a first cloth fabric having a top rectangular portion, a middle portion and a bottom triangular portion; the bottom portion is folded over forwards toward the middle portion, wherein the middle portion includes an eyeglass holder portion to configured to hold eyeglasses; the top rectangular portion configured to fold forward onto the middle portion; and the top triangular portion is attached to a leather strap, wherein the strap is configured to wrap around the first cloth fabric to hold the eyeglasses in the first cloth fabric.

3 Claims, 8 Drawing Sheets

(56) References Cited

U.S. PATENT DOCUMENTS 6,691,863 B1 * 2/2004 Veenstra ..... A45C 11/04 206/371
6,923,313 B1 * 8/2005 Orogun-Thomas ..... A45C 11/043 206/5
7,404,215 B2 * 7/2008 Allen ..... A41D 27/12 2/231
8,393,463 B1 * 3/2013 Graham ..... A45C 11/04 206/37
8,418,267 B2 * 4/2013 Shaw ..... A41D 27/08 2/247
D693,119 S * 11/2013 Butler ..... D3/265
D706,538 S * 6/2014 Harnisch ..... D3/266
D712,144 S * 9/2014 Albanese ..... D3/301
8,961,015 B1 * 2/2015 Bihn ..... A45C 3/001 383/105
9,439,488 B2 * 9/2016 Davis ..... A45C 11/16
9,464,867 B2 * 10/2016 Thompson ..... F41C 33/0263
10,064,468 B2 * 9/2018 Wu ..... A45C 11/04
10,076,179 B2 * 9/2018 Asay ..... A45F 5/021
10,254,569 B2 * 4/2019 Wilson ..... G02C 13/001
2009/0000964 A1 * 1/2009 Omer ..... A45C 11/04 206/5
2009/0026095 A1 * 1/2009 Lofland ..... A45C 11/04 206/5
2013/0001104 A1 * 1/2013 Stutzman ..... A45C 11/04 206/5
2014/0138264 A1 * 5/2014 Rouzeau ..... A45C 11/043 206/5
2014/0158556 A1 * 6/2014 Chammas ..... A61M 1/0272 206/0.5
2014/0190840 A1 * 7/2014 Scribner ..... A45C 11/043 206/5
2014/0262843 A1 * 9/2014 Pluta ..... A45C 11/04 206/5
2015/0305480 A1 * 10/2015 Brousseau ..... A45F 5/10 224/267
2016/0167833 A1 * 6/2016 de Cordova ..... B65D 29/00 383/105

* cited by examiner

SYSTEM FOR CARRYING EYEGLASSES AND CELL PHONES

FIELD OF THE INVENTION

The present invention relates to a system for carrying eyeglasses and cell phones.

BACKGROUND OF THE INVENTION

Generally, when a person has an eyeglass holder or a cell phone holder a person utilizes a hard or soft case where she puts the eyeglass into the eyeglass holder or a cell phone into the cell phone holder. This case is usually a plain color, such as brown or vibrant color such as red or yellow. Usually, the eyeglass holder is not fashionable and is one standard shape. However, the unfashionable eyeglass holder or cell phone holder may not be appropriate for everyone. Therefore, there is a need for an improved system for holding eyeglasses or cell phones.

SUMMARY OF THE INVENTION

The present invention has been accomplished in view of the above-mentioned technical background, and it is an object of the present invention to provide a system for holding a pair of eyeglasses.

In a preferred embodiment of the invention, a system for holding a pair of eyeglasses, the system comprises: a first cloth fabric having a top rectangular portion, a middle portion and a bottom triangular portion; the bottom portion is folded over forward toward the middle portion, wherein the middle portion, includes an eyeglass holder portion configured to hold eyeglasses; the top rectangular portion configured to fold forward onto the middle portion; and the top triangular portion is attached to a leather strap, wherein the strap is configured to wrap around the first cloth fabric to hold the eyeglasses in the first cloth fabric.

In another preferred embodiment of the invention, a system for holding a cell phone is disclosed. The system includes: a first cloth fabric having a top portion, a front portion, a back portion and a bottom portion; the back portion of the first cloth fabric is connected to a back portion of a second cloth, wherein the second cloth is configured to receive and hold a cell phone; the top portion of the first cloth fabric is configure to attach to the bottom portion of the first cloth thereby holding the cell phone therein.

BRIEF DESCRIPTION OF THE DRAWINGS

These and other advantages of the present invention will become more apparent as the following description is read in conjunction with the accompanying drawings, wherein.

DETAILED DESCRIPTION OF THE INVENTION

The presently preferred embodiments of the invention are described with reference to the drawings, where like components are identified with the same numerals. The descriptions of the preferred embodiments are exemplary and are not intended to limit the scope of the invention.

Figure 1A:
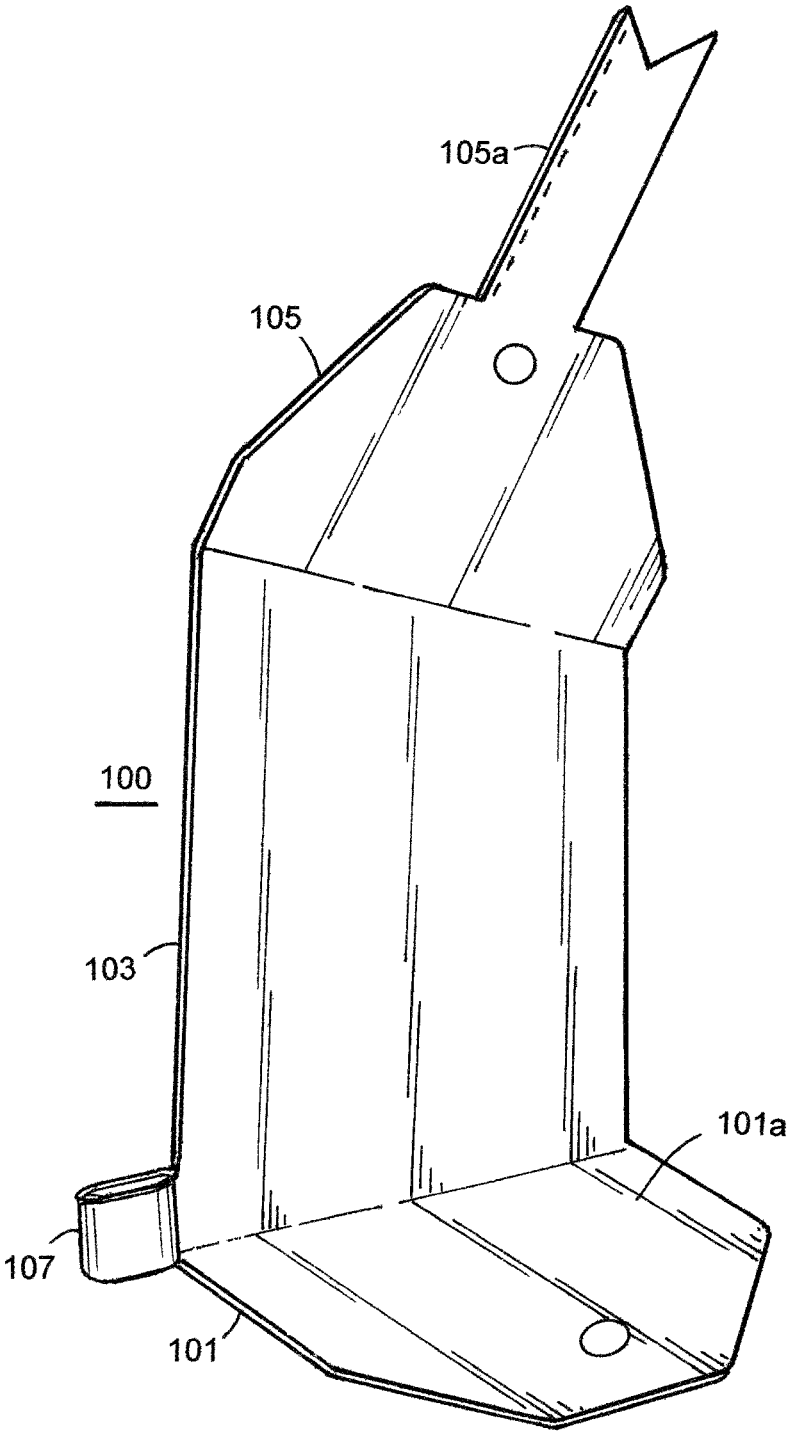
FIG. 1A is a top view of an illustration of a first embodiment of a system for carrying eyeglasses in accordance with the invention.

FIG. 1A is a top view of an illustration of a first embodiment of a system for carrying eyeglasses or eyeglass holder. Eyeglass holder 100 includes three portions a bottom portion 101, a middle portion 103, a top portion 105 and a tab 107. The tab 107 is utilized to attach the eyeglass holder 100 to a hook or ring inside of a typical bag, backpack or purse. Top portion 105 includes a typical hook and loop fastener (i.e. Velcro) 105*a*. Bottom portion 101 and top portion 105 have a trapezoidal shape but may have any type of shape, such as a rectangle, triangle or square. Eyeglass holder 100 may be made out of nylon, plastic, leather, silk or any kind of bendable material.

Figure 1B:
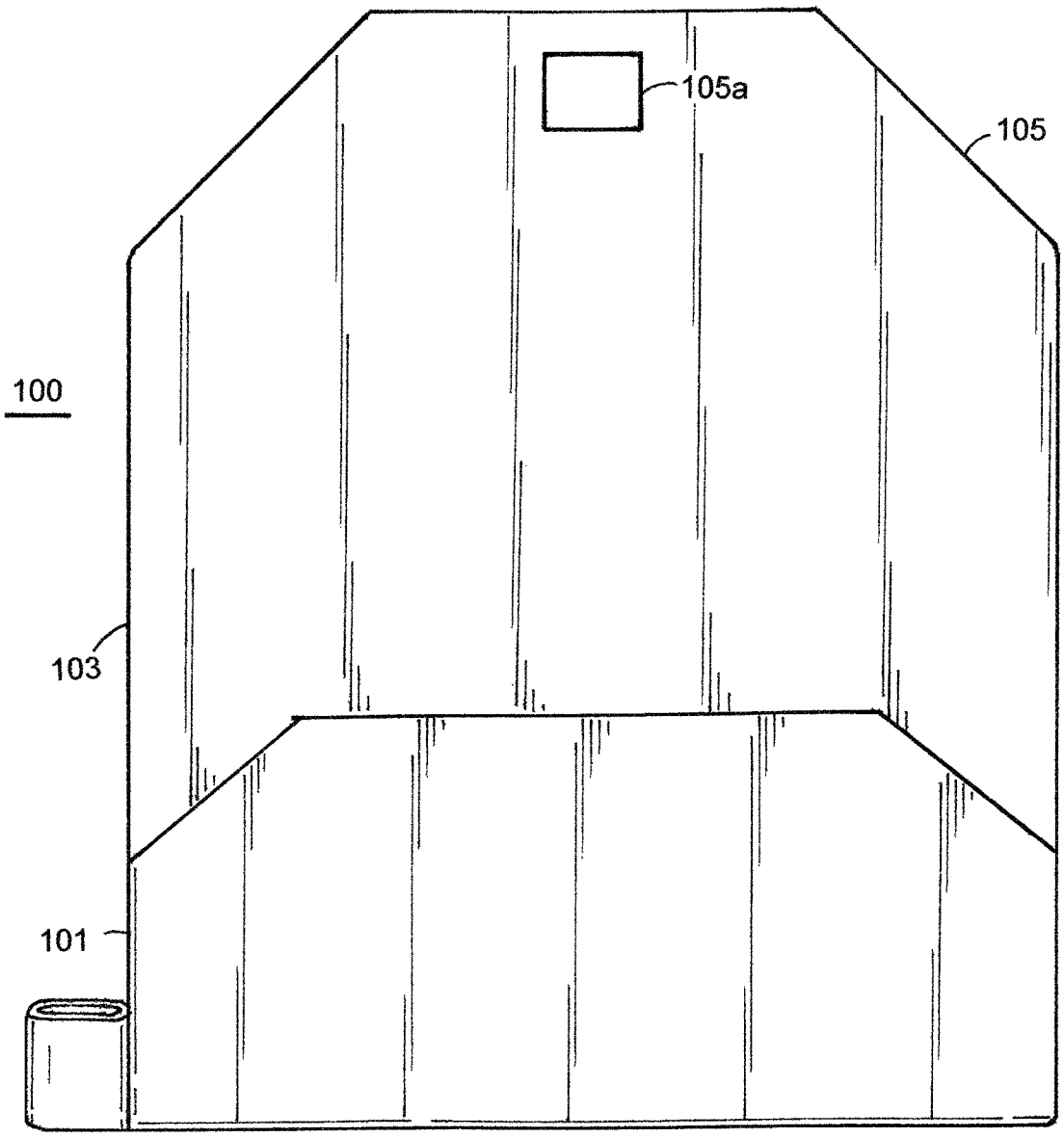
FIG. 1B is another view of an illustration of the first embodiment of a system for carrying eyeglasses in accordance with the invention.
Figure 1D:
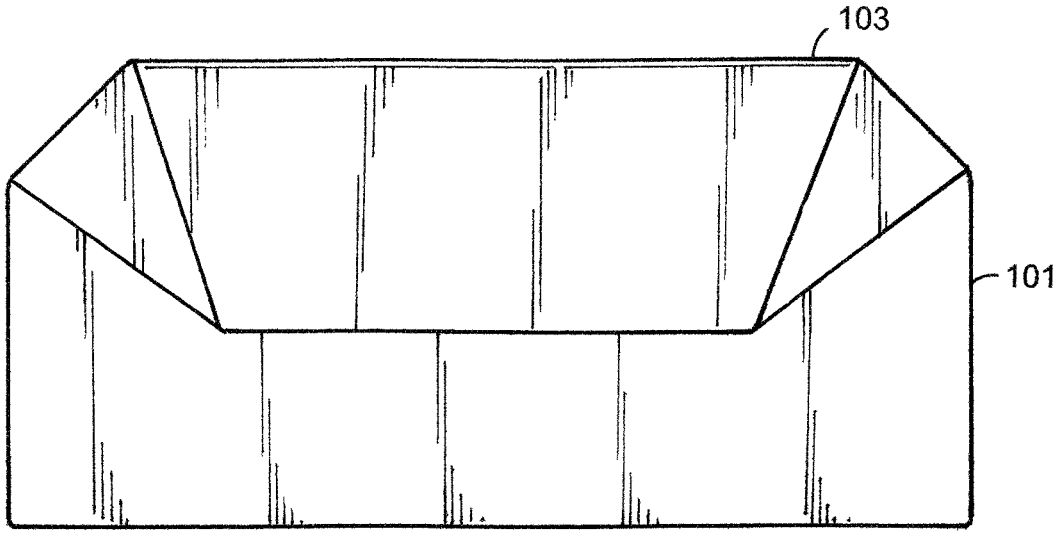
FIG. 1D is another view of an illustration of the first embodiment of a system for carrying eyeglasses in accordance with the invention.
Figure 1C:
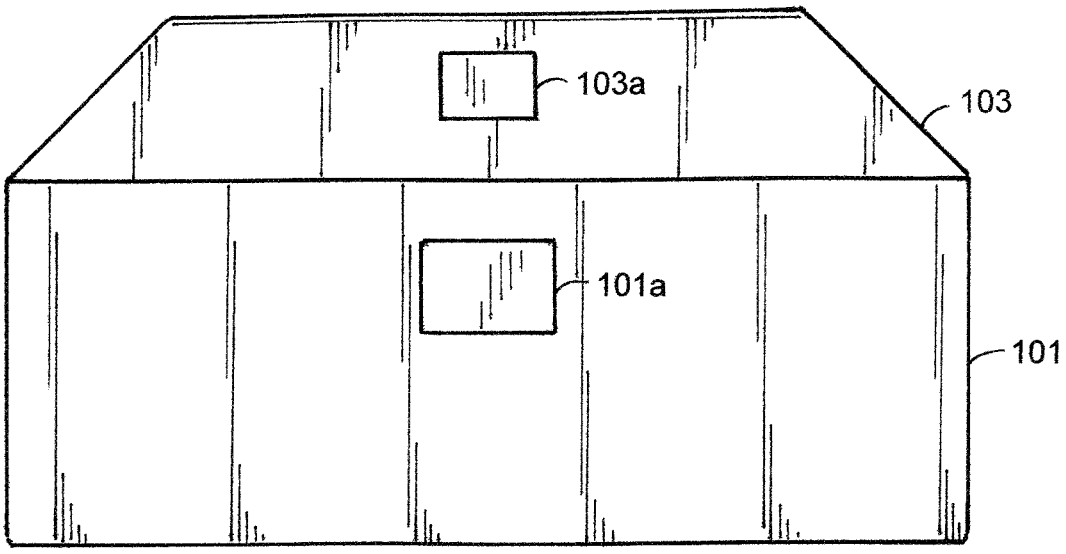
FIG. 1C is another view of an illustration of the first embodiment of a system for carrying eyeglasses in accordance with the invention.

FIG. 1B is another view of an illustration of the first embodiment of a system for carrying eyeglasses where the bottom portion 101 is flipped horizontally onto the middle portion 103. FIG. 1C is yet another view of the first embodiment of the system for carrying eyeglasses where the bottom portion 101 folds horizontally backwards onto the middle portion 103 where a hook and loop fastener (i.e. Velcro) 101*a* is shown. FIG. 1D is yet another view of the first embodiment of the system for carrying eyeglasses where the top portion 105 is folded onto the bottom portion 101 where the hook and loop fastener (i.e. Velcro) 101*a* connects with the hook and loop fastener (i.e. Velcro) 105*a* of the top portion 105.

Figure 2A:
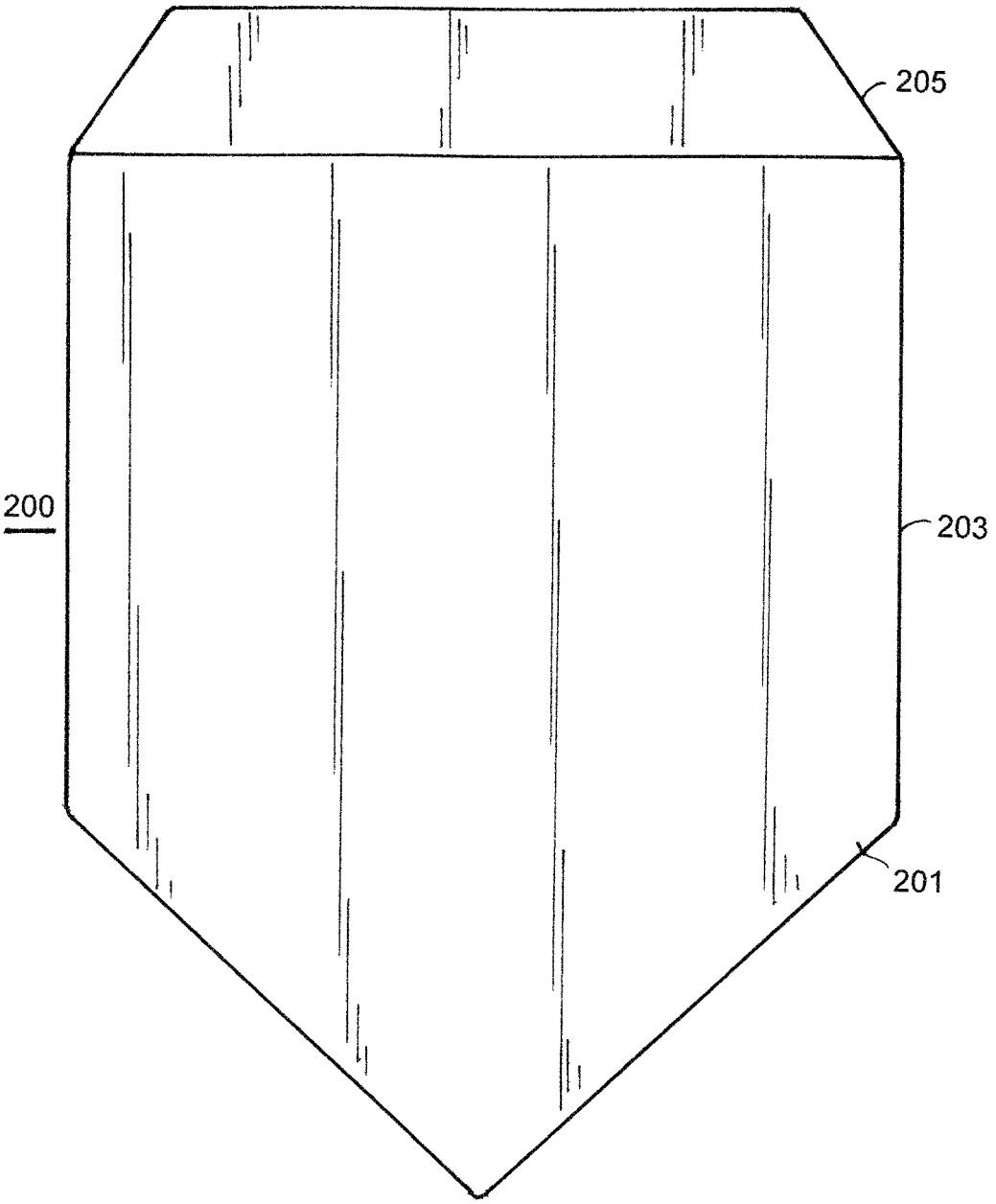
FIG. 2A is a top view of an illustration of a second embodiment of a system for carrying eyeglasses in accordance with the invention.

FIG. 2A is a top view of an illustration of a second embodiment of a system for carrying eyeglasses or eyeglass holder. Eyeglass holder 200 includes a bottom portion 201, middle portion 203 and a top portion 205. The bottom portion 201 has a triangular shape but may have any shape, such as a rectangle, triangle or a square. Top portion 205 has a trapezoidal shape but may also have any type of shape. Eyeglass holder 200 may be made out of nylon, plastic, leather, silk or any kind of bendable material.

Figure 2B:
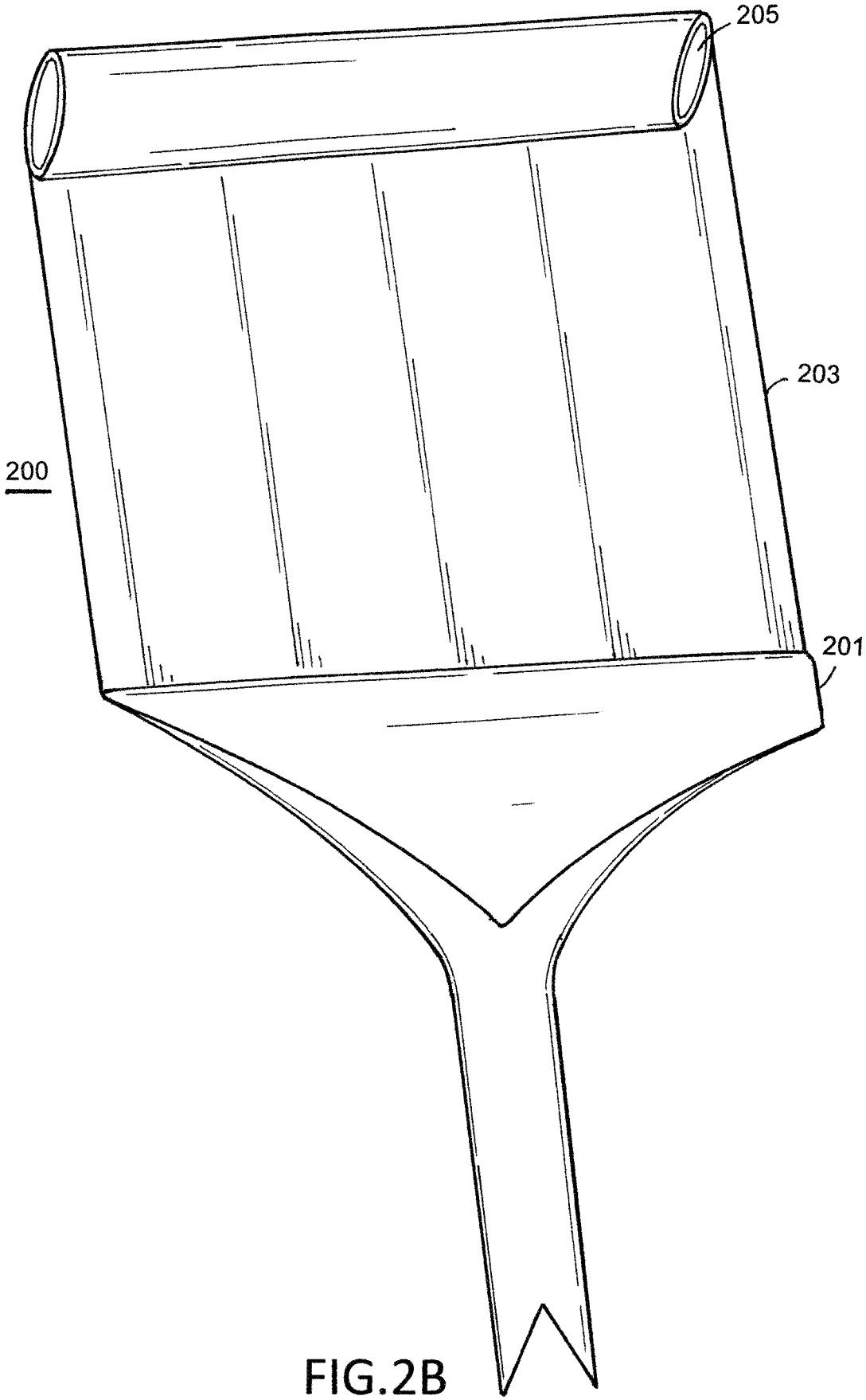
FIG. 2B is another view of an illustration of the second embodiment of a system for carrying eyeglasses in accordance with the invention.
Figure 2C:
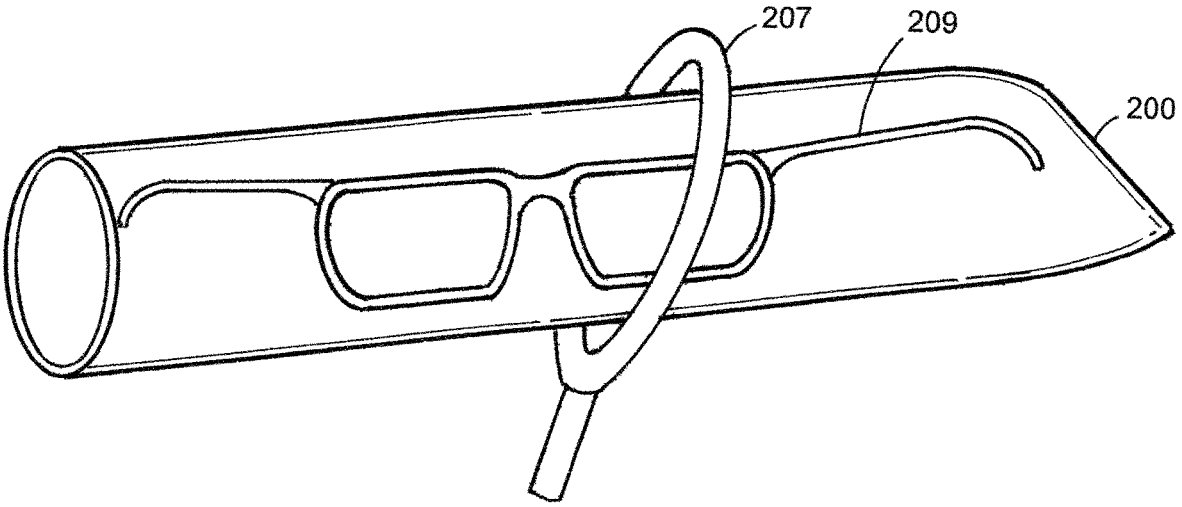
FIG. 2C is another view of an illustration of the second embodiment of a system for carrying eyeglasses in accordance with the invention.

FIG. 2B is another view of an illustration of the second embodiment of a system for carrying eyeglasses. In this illustration that includes the eyeglass holder 200 with the bottom portion 201, middle portion 203 and the top portion 205, where the top portion 205 rolled onto the middle portion 203. FIG. 2C is another view of an illustration of the second embodiment of the eyeglass holder 200 where the top portion 205 that may include a pair of eyeglasses 209 is rolled into the middle portion 203 and bottom portion 201. Eyeglasses 209 may be the standard pair of eyeglasses or sunglasses. The eyeglass holder 200 is then wrapped in a rope type material 207 to keep the eyeglasses secure in the eyeglass holder 200.

Figure 3A:
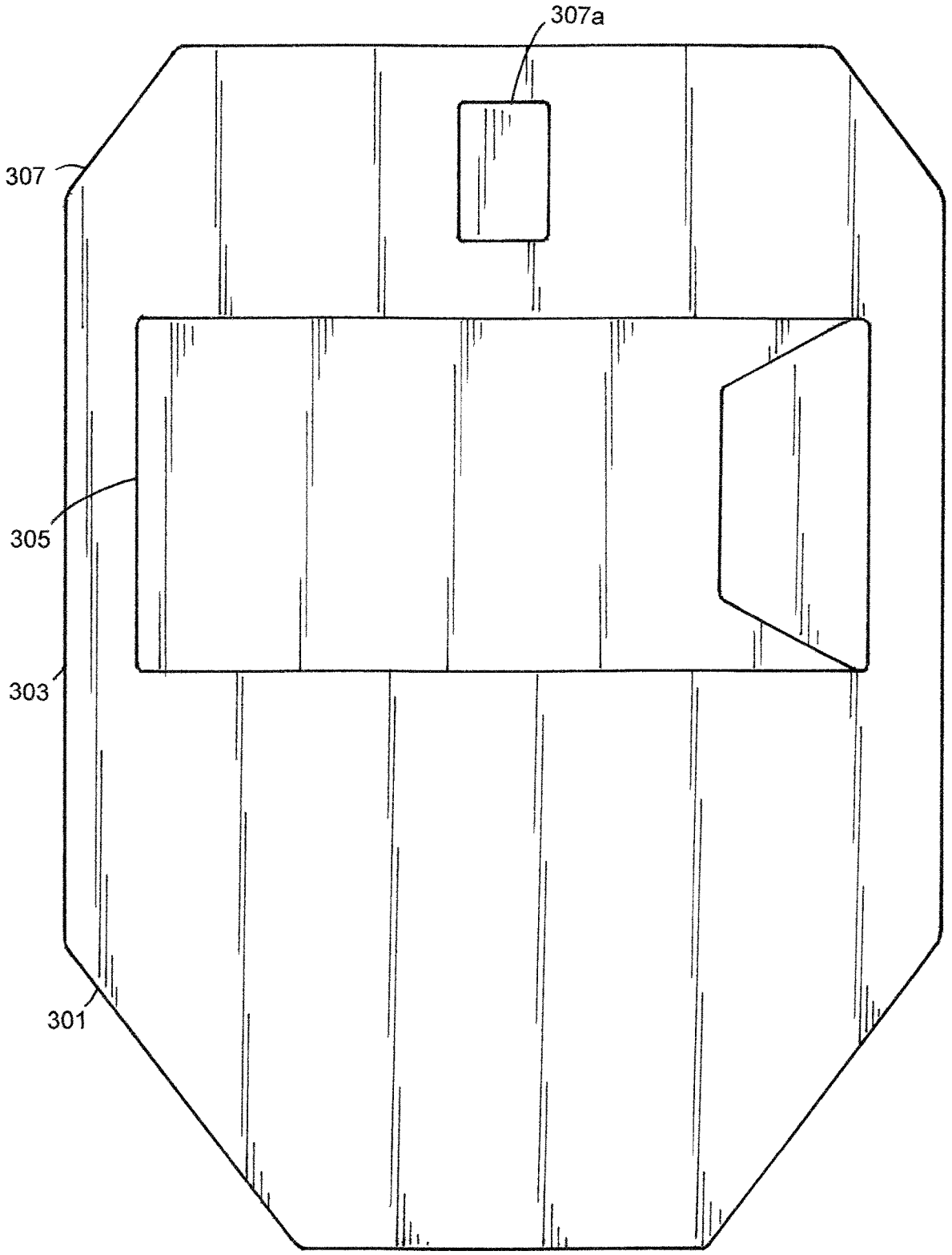
FIG. 3A is a top view of a system for carrying a cell phone in accordance with the invention.
Figure 3B:
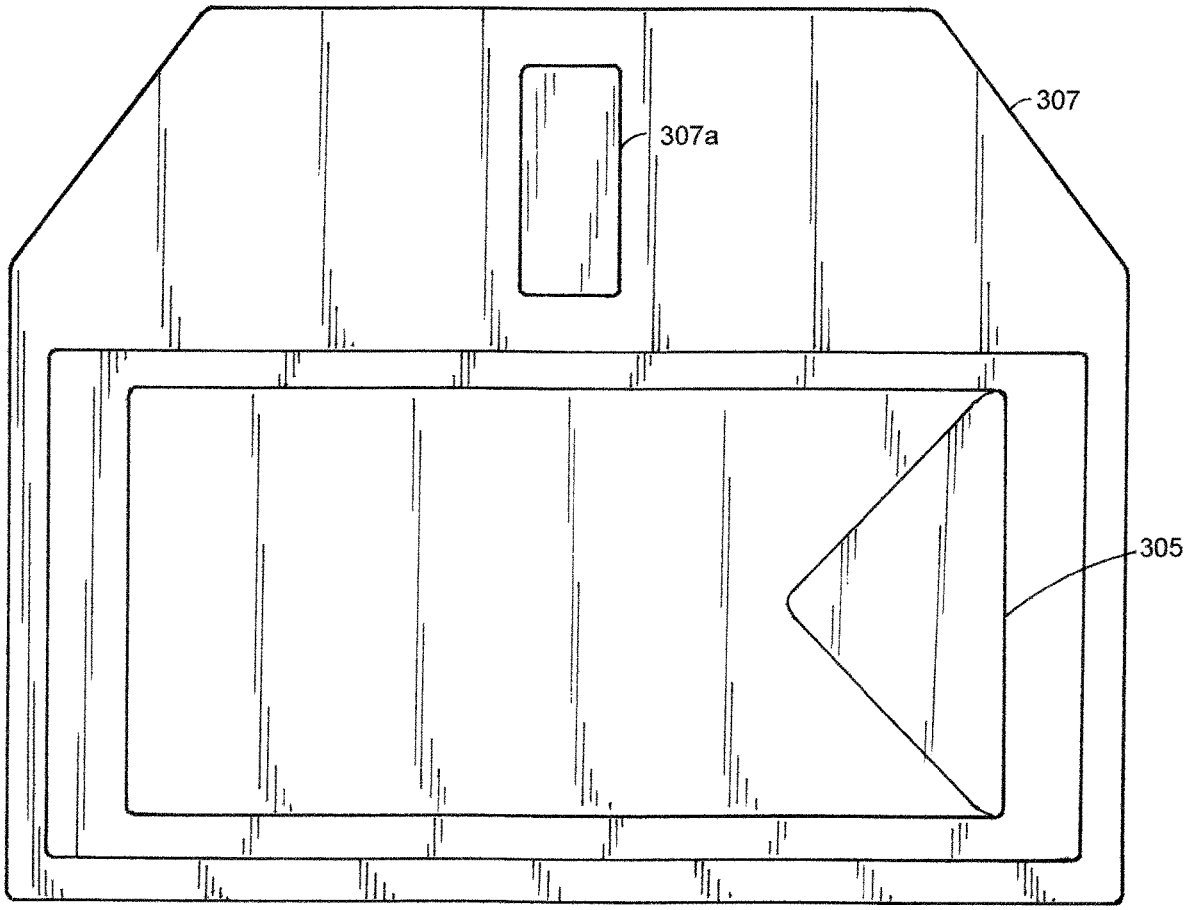
FIG. 3B is another view of the system for carrying the cell phone in accordance with the invention.

FIG. 3A is a top view of an illustration of a system for holding a cell phone or cell phone carrier. Cell phone carrier 300 includes a bottom portion 301, middle portion 303 and a top portion 307. Middle portion 303 includes a cell phone carrier holding compartment 305 that holds any size cell phone. Top portion 307 includes a hook and loop fastener (i.e. Velcro) 307*a* carrying eyeglasses or cell phone holder in accordance with the invention;

FIG. 3B is another view of an illustration of the system for holding a cell phone/mobile phone where the bottom portion 301 is flipped horizontally onto the middle portion 303 and the top portion 307 with the hook and loop fastener (i.e. Velcro) 307*a* may cover the mobile compartment 305.

This invention provides a worry free and simple system for holding a pair of Eyeglasses. The system includes: a first cloth fabric having a top rectangular portion, a middle portion and a bottom triangular portion; the bottom portion is folded over forwards toward the middle portion, wherein the middle portion includes an eyeglass holder portion to configured to hold eyeglasses; the top rectangular portion configured to fold forward onto the middle portion; and the top triangular portion is attached to a leather strap, wherein the strap is configured to wrap around the first cloth fabric to hold the eyeglasses in the first cloth fabric.

What is claimed is:

1. A system for carrying eyeglasses and a cellphone, comprising:

a single piece of material having a first front surface and a second back surface, said single piece of material including: a trapezoidal top portion; a rectangular middle portion; and a trapezoidal bottom portion;

wherein the single piece of material is a bendable material and the trapezoidal bottom portion is configured to fold onto the middle portion on said first front surface of the single piece of material, thereby forming a pocket configured to hold a pair of eyeglasses;

a first hook and loop fastener is coupled to the first front surface on the top trapezoidal portion;

a second hook and loop fastener is coupled to the second back surface of the bottom trapezoidal portion, wherein the first hook and loop fastener is configured to attach to the second hook and loop fastener when the trapezoidal top portion is folded onto the trapezoidal bottom portion;

a tab which forms a loop is coupled to and extends from a lower edge of the rectangular middle section, wherein the tab is configured to attach the system to a hook or ring inside a bag, a purse or a backpack;

a strap connected to and extending from the top trapezoidal portion, wherein the strap is configured to wrap around the entire system for carrying eyeglasses and a cellphone, and;

a cellphone compartment if formed on the second back surface of the rectangular middle portion, wherein said cellphone compartment is configured to hold a cellphone.

2. The system for carrying eyeglasses and a cellphone as claimed in claim 1, wherein the bendable material is selected from the group consisting of leather, rubber, felt, quilt fleece, tapestry nylon, plastic and silk.

3. The system for carrying eyeglasses and a cellphone as claimed in claim 1, wherein the strap is a leather strap.

* * * * *